US005292460A

United States Patent [19]

Kyutoku et al.

[11] Patent Number: 5,292,460

[45] Date of Patent: Mar. 8, 1994

[54] METHOD OF MANUFACTURING A HIGH BULK DENSITY CARBON FIBER FELT

[75] Inventors: Hirofumi Kyutoku, Ikoma; Kouichi Yamamoto, Amagasaki; Yoshihisa Otani, Himeji, all of Japan

[73] Assignees: Osaka Gas Company Limited, Osaka; Japan Felt Industrial Company Limited, Himeji, both of Japan

[21] Appl. No.: 889,365

[22] Filed: May 28, 1992

Related U.S. Application Data

[62] Division of Ser. No. 484,407, Feb. 26, 1990, Pat. No. 5,145,732.

[30] Foreign Application Priority Data

Mar. 1, 1989 [JP] Japan ..... 1-49233
Mar. 23, 1989 [JP] Japan ..... 1-73662
Jun. 12, 1989 [JP] Japan ..... 1-148653

[51] Int. Cl.[5] ..... B32B 5/16

[52] U.S. Cl. ..... 264/29.5; 264/113; 264/122

[58] Field of Search ..... 264/29.5, 29.3, 29.2, 264/122, 324, 113

[56] References Cited

U.S. PATENT DOCUMENTS 3,367,812 2/1968 Watts ..... 264/29.5
4,256,801 3/1981 Chuluda .
4,396,669 8/1983 Cariou .
4,508,777 4/1985 Yamamoto et al. .
4,654,242 3/1987 Schieber .
4,726,987 2/1988 Trask et al. .
4,770,925 9/1988 Uchikawa et al. .
4,861,653 8/1989 Parrish .
4,902,561 2/1990 McCullough et al. .
4,983,451 1/1991 Sugino et al. .
4,987,664 1/1991 McCullough, Jr. .

FOREIGN PATENT DOCUMENTS 79808 5/1983 European Pat. Off. .
WO89/03764 5/1989 PCT Int'l Appl. .
WO89/08162 9/1989 PCT Int'l Appl. .

*Primary Examiner*—Jan H. Silbaugh
*Assistant Examiner*—Mathieu Vargot
*Attorney, Agent, or Firm*—Spencer, Frank & Schneider

[57] ABSTRACT

Polymer-type fibers longitudinally shrinkable by calcination and other carbon fibers are mixed and mechanically compressed and integrated by a needle punch, and the polymer-type fibers are then shrunk when calcined. Thus, there is obtained high bulk density carbon fiber felt having average bulk density of 0.1 g/cm$^3$ or more without the carbon fiber felt impregnated with, resin and compressingly molded. The density of carbon fiber felt may change in the thickness direction thereof. The high bulk density carbon fiber felt may be used as a thermal insulator for a high-temperature furnace, a heat-resisting cushioning material, and a material for the electrode of a secondary battery.

13 Claims, 2 Drawing Sheets

METHOD OF MANUFACTURING A HIGH BULK DENSITY CARBON FIBER FELT

This is a division of application Ser. No. 07/484,407 filed Feb. 26, 1990, now U.S. Pat. No. 5,145,732.

FIELD OF THE INVENTION

The present invention relates to (i) high bulk density carbon fiber felt suitably used as a thermal insulator for a high-temperature heat-treatment of a variety of articles, a cushioning material, a material for the electrodes of a secondary battery or the like, (ii) a method of manufacturing such felt, and (iii) a thermal insulator using such felt.

BACKGROUND OF THE INVENTION

Carbon fiber felt is excellent in heat resistance to a high temparature, thermal insulating properties and the like. Accordingly, such felt is used as a thermal insulator in a high-temperature furnace such as a ceramic sintering furnace, a vacuum furnace for evaporation deposition of metal, a furnace for growing semiconducting single crystals, or the like.

On the other hand, the inventors have reported in Collection of Outlines of Lectures, 1143–1148P, of First Japan International SAMPE Symposium & Exhibition (Nov. 30, 1989) that the dependency of thermal conductivity on temperature varies with the bulk density of carbon fiber felt. More specifically, as shown in FIG. 1, the thermal conductivity $\lambda$ serving as an index of thermal insulating properties in a high-temperature furnace closely relates to the bulk density $\rho$ of carbon fiber felt. In a high-temperature zone, the thermal conductivity $\lambda$ generally becomes smaller as the bulk density $\rho$ is greater. In a low-temperature zone, the thermal conductivity $\lambda$ generally becomes smaller as the bulk density $\rho$ is smaller. Further, the thermal insulating properties become greater as the carbon fiber felt is thicker.

Since the carbon fiber felt is excellent in electric conductivity, it has been proposed to use the carbon fiber felt as a material for the electrodes of a secondary battery of the Na-S type or the like. Since the electrode material is required to have a number of electric active sites, a predetermined repulsion force or the like, it has been considered that carbon fiber felt having bulk density of 0.1 g/cm$^3$ or more is desired as such an electrode material.

In view of the foregoing, (1) the Japanese Patent Publication No. 35930/1975 proposes a method of manufacturing a molded thermal insulator comprising the steps of:

impregnating carbon fiber felt with resin which can be carbonized or graphitized;

winding the resin-impregnated felt on a mandrel;

mounting a thin steel sheet on the outer circumference of the felt thus wound on the mandrel;

fastening the wound felt and sheet with a belt or the like, causing the felt to be compressed, thereby to produce a hollow cylindrical molded article having desired thickness and bulk density; and carbonizing or graphitizing the molded article.

The Japanese Utility Model Publication No. 29129/1983 proposes a multi-layer molded thermal insulator for a vacuum furnace, comprising (i) permeable carbon fiber felt sheets formed through the steps of impregnation with a resin solution, compression and carbonization, and (ii) graphite sheets with a thickness of 1 mm or less having sealing properties, the felt sheets and the graphite sheets being alternately laminated through adhesives.

To increase the bulk density of the molded thermal insulator above-mentioned, there are required a variety of steps, i.e., resin impregnation, compression-molding, drying-setting, and calcination. In the resin impregnation step, it is required to use a viscous resin solution which decreases the workability. Further, the resin-impregnated felt is subjected to compression-molding and drying-setting. This not only takes a lot of time for molding, but also requires treatment with an organic solvent. Accordingly, the workability and the productivity are lowered.

It is difficult to uniformly impregnate the carbon fiber felt with resin, and the felt is fastened, at the compression-molding step, with a band or the like. Accordingly, the resultant molded thermal insulator lacks uniformity. The molded thermal insulator is integrated with carbonized resin and is hard. Accordingly, the molded thermal insulator lacks resiliency and cushioning properties. This causes the thermal insulator to be easily broken at the time of processing or attachment thereof in a furnace. Accordingly, when attaching, to a furnace, a sheet-like thermal insulator or a thermal insulator having a curved section with both end surfaces thereof bonded to each other, it is difficult to align the end surfaces to be bonded and to closely bond the end surfaces to each other. This produces gaps between the bonded end surfaces to lower the thermal insulating properties.

The molded thermal insulator obtained through a compression-molding step presents the same bulk density in the thickness direction thereof. This does not provide sufficient thermal insulating properties in a high- or low-temperature zone.

In this molded thermal insulator, the restoring force required as a heat-resisting cushioning material is small, and the durability is therefore not sufficient.

Since the felt is calcined after resin-impregnation, the molded thermal insulator is apt to be easily warped. Further, while being machined or used, the thermal insulator generates a great amount of powder due to impregnated resin. This involves the likelihood that the powder thus produced contaminates workpieces to be heated in a high-temperature furnace.

On the other hand, (2) as to mechanically bonded carbon fiber felt without impregnation with resin, the bulk density is small. Accordingly, the thermal insulating properties at a high temperature are small. Therefore, such felt is not suitable as a thermal insulator for a high-temperature furnace. To ensure the thermal insulating properties at the time of heat treatment at a high temperature, it is required to attach a plurality of felt pieces to a large-size high-temperature furnace or the like. This presents the problem that the felt attachment is troublesome.

Further, the felt itself has small mechanical strength and lacks the shape holding properties. This makes it difficult to handle the felt. For example, felt made of, as a starting material, phenol resin-type fibers which can be carbonized, has small bulk density and small mechanical strength when the felt has a thickness of 3 mm. Accordingly, a foundation cloth is required. As to carbon fiber felt obtained by carbonizing felt having a thickness of about 5 to about 7 mm, the bulk density at the time when no load is applied, is generally as small as 0.1 g/cm$^3$, and the thickness is also small. Thus, the thermal insulating properties are lowered. If such felt is graphitized, the bulk density is further reduced, thereby to lower the thermal insulating properties. As to carbon fiber felt obtained by graphitizing felt having a thickness of 10 mm or more, the bulk density is generally lowered to about 0.08 g/cm$^3$. This is presumably caused by great decrease in weight and great reaction heat at the time of carbonization or graphitization.

When rayon or polyacrylonitrile fibers which are a carbon fiber material, are needled, the bulk density of felt before the fibers are carbonized, is increased. However, at the time of carbonization and graphitization, the weight is considerably decreased and the bulk density is considerably decreased. The resultant carbon fiber felt presents small mechanical strength, causing the felt to be easily broken. Thus, the durability is insufficient.

SUMMARY OF THE INVENTION

It is an object of the present invention to provide high bulk density carbon fiber felt without resin impregnation.

It is another object of the present invention to provide high bulk density carbon fiber felt and a thermal insulator, which are excellent in thermal insulating properties, cushioning properties, resiliency and durability.

It is a further object of the present invention to provide high bulk density carbon fiber felt and a thermal insulator, which are adapted not to contaminate workpieces to be heated, and which are excellent in adhesion of the bonded end surfaces thereof, and which present neither partial breakage nor warp.

It is still another object of the present invention to provide high bulk density carbon fiber felt and a thermal insulator, each of which thickness is great and bulk density varies in the thickness direction thereof, and which are excellent in thermal insulating properties.

It is a still further object of the present invention to provide a method of manufacturing, without use of resin impregnation, high bulk density carbon fiber felt excellent in thermal insulating properties, cushioning properties, resiliency, mechanical strength and durability.

It is yet another object of the present invention to provide a method of manufacturing, with good productivity and workability, high bulk density carbon fiber felt of which thickness is great and bulk density varies in the thickness direction thereof.

To achieve the objects above-mentioned, the present invention provides high bulk density carbon fiber felt having average bulk density of 0.1 g/cm$^3$ or more and in which carbon fibers obtained by carbonizing and/or graphitizing polymer-type fibers longitudinally shrinkable by calcination are entangled with another carbon fibers.

The present invention also provides a method of manufacturing high bulk density carbon fiber felt comprising the steps of:

mixing together (i) fibers of at least one type selected from the group consisting of carbon fibers, pitch-type fibers subjected to an infusible treatment, and rayon-, polyacrylonitrile- and cellulose-type fibers subjected to an infusible treatment, and (ii) polymer-type fibers which are longitudinally shrunk by calcination and which can be carbonized and/or graphitized;

mechanically compressing and entangling the fibers with polymer-type fibers above-mentioned to prepare a felt; and calcining the felt.

The present invention also provides a method of manufacturing high bulk density carbon fiber felt in the form of a hollow case comprising the steps of:

mechanically compressing and entangling the fibers with polymer-type fibers mentioned earlier, thereby to prepare a hollow casing felt; and calcining the felt above-mentioned.

The present invention also provides a method of high bulk density carbon fiber felt in the form of a hollow case comprising the steps of:

mechanically compressing and entangling the fibers with polymer-type fibers mentioned earlier, thereby to prepare a plurality of hollow casing felt pieces which can be mounted concentrically;

concentrically mounting these hollow casing felt pieces; and calcining the concentrically mounted felt pieces.

According to the method of the present invention, the polymer-type fibers are shrunk and carbonized by calcination, thereby to fasten the entangled fibers. Thus, there may be prepared carbon fiber felt having high bulk density without the felt compressingly molded as impregnated with resin.

The present invention also provides a thermal insulator comprising at least one high bulk density carbon fiber felt of which bulk density is 0.1 g/cm$^3$ or more and preferably 0.13 g/cm$^3$ or more, and at least one carbon-based sheet laminated on the felt through a carbonized or graphitized adhesive layer.

The present invention provides a thermal insulator comprising high bulk density carbon fiber felt having average bulk density of 0.1 g/cm$^3$ or more, and having at least one surface which is coated with a coating layer comprising scale-like graphite, carbon-type powder and substance obtained by carbonizing or graphitizing resin.

The terms in the present specification are defined as follows.

The polymer-type fibers which are longitudinally shrunk by calcination and which can be carbonized and/or graphitized, refer to fibers which can be used for the present invention after having been subjected to an infusible treatment, and fibers which can be used for the present invention without being subjected to an infusible treatment. The term of polymer-type fibers used in the specification, refers to both fibers above-mentioned.

The term of "longitudinally shrunk" means that fibers are shrunk in the axial directions thereof.

The infusible treatment refers to treatment for heating fibers at a temperature of about 200° to about 450° C., for example in the presence of oxygen, to form heat-resisting layers on the surfaces of the fibers, thereby to prevent the fibers from being molten when calcined.

The carbonization refers to treatment for calcining fibers at a temperature of, for example, about 450° to about 1500° C.

The graphitization refers to treatment for calcining fibers at a temperature of, for example, about 1500° to about 3000° C. Even though the fibers thus treated have no crystal structure of graphite, these fibers are included in graphitized fibers.

The carbon fibers refer to fibers which are carbonized or graphitized.

These objects and advantages of the present invention will be better understood with reference to the following detailed description and attached drawings.

DETAILED DESCRIPTION OF THE INVENTION

Figure 1:
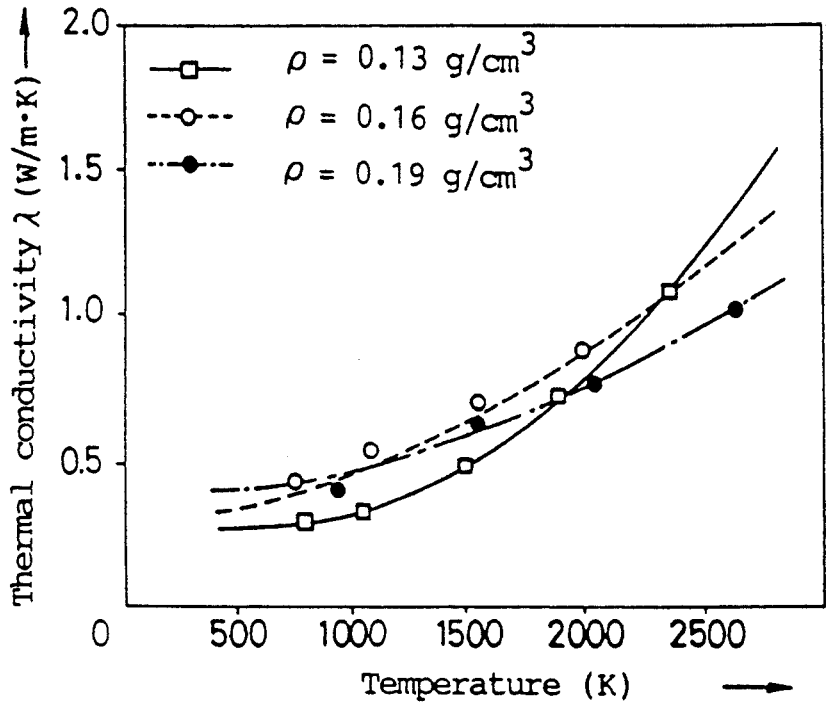
FIG. 1 is a graph illustrating the relationship between thermal conductivity λ and bulk density ρ of carbon fiber felt.

The high bulk density carbon fiber felt in accordance with the present invention comprises polymer-type carbon fibers obtained by carbonizing and/or graphitizing polymer-type fibers longitudinally shrinkable by calcination, and other carbon fibers. No particular restrictions are imposed on the polymer-type carbon fibers above-mentioned, as far as they are fibers made of polymer-type fibers which are longitudinally shrunk by calcination and which can be carbonized and/or graphitized.

Examples of the polymer-type fibers include: phenol resin-type fibers, polymer fibers such as heat shrinkable polyacrylonitrile fibers, rayon fibers or the like; non-melting fibers having no definite heat-melting point such as aramid-type fibers or the like; and fibers of the thermosetting type such as fibers of epoxy resin, polyurethane, urea resin or the like. Of these examples, the phenol resin-type fibers are preferable.

The phenol resin-type fibers present less decrease in weight and great shrinkage when carbonized and/or graphitized. Thus, there is obtained carbon fiber felt having high bulk density. Examples of the phenol resin-type fibers include fibers made of phenol resin such as novoroid fibers made of novolac-type phenol resin, or the like. At least one type of the polymer-type carbon fibers is used. Different types of the polymer-type carbon fibers may be jointly used.

Particular restrictions are not imposed on the other carbon fibers above-mentioned, as far as they are made of fibers which can be carbonized. Examples of the another carbon fibers include: polymer-type carbon fibers such as polyacrylonitrile-, rayon-, cellulose-type carbon fibers; carbon fibers made of pitch-type fibers such as a petroleum-type pitch, a coal-type pitch, a liquid crystal pitch or the like. One or more types of such fibers are used.

Each of the polymer-type carbon fibers and the other carbon fibers above-mentioned may have a suitable fiber diameter in a range from about 5 to about 30 μm.

The polymer-type carbon fibers and the another carbon fibers are mixed without impregnation with resin. The polymer-type carbon fibers which are entangled with the other carbon fibers and obtained by carbonizing or graphitizing longitudinally shrinkable polymer-type fibers, tighten the other carbon fibers, thereby to increase the bulk density of the carbon fiber felt. The carbon fiber felt impregnated with no resin, is excellent in cushioning properties, resiliency, durability, non-contamination of workpieces to be heated, and adhesion of both bonded end surfaces. Further, when mounted on a high-temperature furnace, the carbon fiber felt does not become partially broken. Moreover, the carbon fiber felt is not warped when calcined.

The mixing ratio of the polymer-type carbon fibers to the another carbon fibers is generally in a range from 3/97 to 92/8 parts by weight, preferably from 6/94 to 84/16 parts by weight, and more preferably from 14/86 to 64/36 parts by weight.

The bulk density of the carbon fiber felt may be wholly uniform or may be distributed. The average bulk density of the high bulk density carbon fiber felt is generally 0.1 g/cm$^3$ or more, preferable in a range from 0.1 to 0.2 g/cm$^3$ and more preferably from 0.13 to 0.2 g/cm$^3$. If the average bulk density is not greater than 0.1 g/cm$^3$, the thermal insulating properties in a high-temperature zone are not sufficient. When the bulk density is uniform in the entirety of the felt, the bulk density may be 0.1 g/cm$^3$ or more. When the bulk density is distributed, the average bulk density may be 0.1 g/cm$^3$ or more and the bulk density may be distributed in a range from 0.05 to 0.20 g/cm$^3$.

When the bulk density is distributed, the bulk density preferably varies continuously or gradually in the thickness direction in order to increase the thermal insulating properties. In this case, the distribution of the bulk density may be determined according to the temperature of a high-temperature furnace to be used, or the like. More specifically, as is apparent from the relationship between bulk density ρ of carbon fiber felt and thermal conductivity λ shown in FIG. 1, the carbon fiber felt having bulk density reduced continuously or gradually from a high-temperature zone to a low-temperature zone, presents excellent thermal insulating properties in all temperature fields from the low-temperature zone to the high-temperature zone, particularly when the carbon fiber felt is mounted on a high-temperature furnace or the like. The carbon fiber felt of which the bulk density varies in the thickness direction, is superior in thermal insulating properties to felt having constant bulk density. Accordingly, such felt may be generally reduced in thickness. This results in economy and reduction in heat capacity.

The preferred high bulk density carbon fiber felt comprises layers of carbon fiber felt of different bulk densities, and the bulk density of the felt is changed layer by layer in the thickness direction of the felt.

The thickness of the high bulk density carbon fiber felt is not particularly limited to a certain value. When the working temperature is 1500° C. or more, the felt preferably has a thickness of 20 mm or more. In the high bulk density carbon fiber felt in accordance with the present invention, even though the thickness is 10 mm or more, the bulk density at the time when no load is applied, is generally 0.1 g/cm$^3$ or more. Accordingly, even a single felt piece may ensure excellent thermal insulating properties. Even though the thickness is about 3 mm, the high bulk density carbon fiber felt of the present invention has, without use of a foundation cloth, mechanical strength which presents no practical hindrance.

The shape of the high bulk density carbon fiber felt may be suitably formed according to the application. When the felt is used as a thermal insulator, it preferably has a plate shape or a hollow casing shape. The carbon fiber felt having the hollow casing shape, may have a circular or polygonal section (quadrilateral section or the like). The high bulk density carbon fiber felt may be composed of either a single felt layer, or a plurality of felt layers having different bulk densities.

The high bulk density carbon fiber felt in accordance with the present invention may be produced according to a method comprising the steps of:

mixing together (i) fibers of at least one type selected from the group consisting of carbon fibers, pitch-type fibers subjected to an infusible treatment, rayon-, polyacrylonitrile- and cellulose-type fibers subjected to an infusible treatment (hereinafter generally referred to as carbon fibers, unless otherwise specified), and (ii) polymer-type fibers which are longitudinally shrunk by calcination and which can be carbonized and/or graphitized (hereinafter referred to as shrinkable fibers), thereby to form a web or lap;

mechanically compressing and entangling the carbon fibers with the shrinkable fibers above-mentioned in the web or lap, causing the web or lap to be compressingly integrated to prepare a felt; and calcining the compressingly integrated the felt.

As the carbon fibers and the shrinkable fibers used in the mixing step, there may be used fibers made of the materials mentioned earlier. When the shrinkable fibers are used, the shrinkable fibers are shrunk as entangled with the carbon fibers, thereby to increase the bulk density.

The mixing ratio of the shrinkable fibers to the carbon fibers in the mixing step, is determined with reduction in weight by carbonization or graphitization taken into consideration. That is, the mixing ratio of the shrinkable fibers to the carbon fibers is generally in a range from 5/95 to 95/5 parts by weight, preferably from 10/90 to 90/10 parts by weight, and more preferably from 25/75 to 75/25 parts by weight.

The use of the carbon fibers not greater than 5 parts by weight involves the likelihood that the mixing uniformity scatters and the carbon fibers are dispersed when mixing, with the use of a carding machine, the carbon fibers as mixed with the shrinkable fibers. On the other hand, if the carbon fibers exceed 95 parts by weight, it is difficult to increase the bulk density. Thus, when the mixing ratio is adjusted in the range above-mentioned, the density of the carbon fiber felt may be readily controlled.

When carbon fiber felt is prepared only from carbon fibers obtained by carbonization or graphitization, the fibers may be readily cut at the mechanical compression-integration step since such carbon fibers present small shearing strength. It is therefore difficult to enhance the fiber entanglement, or to increase the bulk density.

Then, there is prepared a web in which the mixed fibers are made in the form of a sheet, or a lap in which a plurality of webs are laminated. The web or lap is mechanically compressed and integrated at the compression-integration step. Thus, the bulk density of the felt is increased. The web or lap may be prepared according to a conventional method, for example, with the use of a carding machine. The orientation of the fibers in the web or lap may be arranged in one or different directions.

The mechanical compression-integration may be achieved by a stitching method by which the web or lap is sewed. However, a needle punch method is preferable. According to the needle punch method, the carbon fibers and the shrinkable fibers may be mechanically uniformly entangled with each other. Further, the compression degree and bulk density of the felt may be readily controlled by adjusting needle density expressed by the number of needles which pass a unit area. It is noted that, when the fibers are mechanically compressed and integrated after mixing the carbon fibers and the shrinkable fibers, there is no possibility of the resultant felt being considerably decreased in mechanical strength, even though the felt has a small thickness. According to the present invention, the felt is not impregnated with resin but is mechanically compressed and integrated, in order to adjust the bulk density. Thus, the workability is not lowered.

At the compression-integration step, it is preferable to prepare not only plate-like felt, but also hollow casing felt. The hollow casing felt may be prepared, for example, by needling the web or lap wound on a cylindrical bed of a needling machine.

At the compression-integration step, there may be obtained plate-like or hollow casing felt of which bulk density is changed in the thickness direction thereof. For making felt in the form of, for example, a plate, a plurality of webs or laps having different mixing ratios may be needled, thereby to obtain felt of which bulk density is changed gradually in the thickness direction. For a plurality of webs or laps having the same mixing ratio, the needle density in the thickness direction may be changed when needling the webs or laps as laminated. In this case, the fibers in the upper layer move toward the lower layer, thereby to increase the bulk density in the lower layer. Thus, there may be obtained felt of which bulk density is changed continuously or gradually in the thickness direction. When the needle density is increased, the bulk density distribution is changed from gradual distribution to continuous distribution. It is possible to form plate-like felt generally having a thickness up to about 50 mm.

Hollow casing felt of which bulk density is changed in the thickness direction, may be prepared by needling a plurality of webs or laps having the same mixing ratio or different mixing ratios which are wound, in lamination, on a cylindrical bed of a needling machine. When preparing hollow casing felt according to the method above-mentioned, the fibers are moved, at the time of needling, in one direction, i.e., the center direction. Accordingly, the bulk density in the thickness direction is increased in a radial direction toward the inner side of the hollow casing felt. Thus, the bulk density is continuously or gradually changed.

The sizes of the hollow casing felt are not particularly limited to certain values. For hollow cylindrical felt, the inner diameter is in a range from 20 to 15000 mm $\phi$, and preferably from 200 to 3000 mm $\phi$, and the length is 3000 mm or less. Hollow cylindrical carbon fiber felt having a great inner diameter may be obtained by preparing and calcining felt in the form of an endless belt. When making hollow cylindrical felt from a single lap, there may be prepared felt having a thickness up to about 50 mm.

According to another embodiment of the present invention, carbon fiber felt having a thickness of 50 mm or more may be readily prepared with the use of shrink force of the shrinkable fibers. More specifically, a plurality of hollow casing felt pieces, each having a thickness of 50 mm or less, which may be mounted concentrically, may be prepared by mechanical compression-integration as done in the embodiment mentioned earlier. After concentrically mounted, the hollow casing felt pieces may be calcined. At the time of calcination, the shrinkable fibers are shrunk. Accordingly, the hollow casing felt pieces in lamination are closely sticked and integrated. Thus, carbon fiber felt having a great thickness may be prepared. It is noted that a plurality of hollow casing felt pieces may be so prepared as to be mounted concentrically in a coaxial, for example concentric, manner.

To efficiently apply the shrink force of the shrinkable fibers, it is preferable to calcine the mutually mounted hollow casing felt pieces with a metallic or carbon case body inserted into the hollow portion of the innermost hollow casing felt piece, the case body having such an outer diameter as fitted in the inner diameter of the innermost hollow casing felt piece. When the case body is mounted, there may be prepared hollow casing carbon fiber felt having a hollow portion corresponding to the outer shape of the case body. At least two hollow casing felt pieces may be mounted concentrically. When a plurality of hollow casing felt pieces having different bulk densities are used, there may be readily obtained a multi-layer hollow casing lamination body of which bulk density is changed in the thickness direction.

The thickness and adhesion of the hollow casing carbon fiber felt obtained after the calcination step, may be readily controlled by previously measuring the shrinkage factors of the respective hollow casing felt pieces and adjusting, prior to calcination, the thicknesses of the hollow casing felt pieces based on the values thus measured.

By calcining the mechanically compressed and integrated felt, there may be obtained high bulk density carbon fiber felt. At the calcination step, the carbonization and graphitization are generally carried out under vacuum or in an inert atmosphere. Examples of inert gas for forming the inert atmosphere include nitrogen, helium, argon or the like. The calcination temperature may be suitably set according to the application of the high bulk density carbon fiber felt. There are instances where the calcination temperature is set to 200° C. or more.

When the thicknesses of felt are increased, the bulk density is apt to be increased. When the shrinkable fibers and the carbon fibers obtained through carbonization or graphitization are jointly used, the general reduction in weight due to calcination is small. When calcined, the shrinkable fibers are reduced in weight by about 30 to 50 %. If the carbon fibers are, for example, carbonized pitch-type carbon fibers, these carbonized pitch-type carbon fibers are reduced in weight merely by about 10 to 15% even though graphitized. This restrains the entire fibers from being reduced in weight. To minimize the reduction in weight, it is preferable to use previously carbonized or graphitized carbon fibers.

Even after the fibers have been calcined, the bulk density is not decreased, but is rather increased. This is considered because the shrinkable fibers are carbonized while being shrunk, thus causing the shrinkable fibers to so act as to fasten the other carbon fibers.

The high bulk density carbon fiber felt thus obtained may be not only used independently as a thermal insulator, a cushioning material, or a material for the electrodes of a secondary battery, but also useful to form a thermal insulator as combined with a carbon-based sheet.

An example of the carbon-based sheet includes a graphite sheet excellent in sealing properties and heat resistance. The thickness of the carbon-based sheet may be suitably selected That is, it may be in such a range as to prevent the thermal capacity from being considerably increased, e.g., a range from 0.1 to 5 mm, and preferably from about 0.2 to about 0.5 mm. When the carbon-based sheet is laminated on the high bulk density carbon fiber felt, the wind resisting properties may be improved. The graphite sheet may be made as follows. Graphite powder is treated with sulfuric acid, causing the graphite powder to be expanded, and the powder thus expanded is subjected to rolling-extrusion or the like, thereby to be formed into a flexible sheet. The graphite sheet generally has density from about 0.5 to about 1.6 g/cm$^3$.

As another example of the carbon-based sheet, there may be used a sheet obtained by carbonizing or graphitizing a carbon fiber cloth which has been molded with resin. To increase the carbonization yield, carbon-type powder (including minute spherical particles such as mesocarbon micro-beads) or milled carbon fibers may be mixed with the resin. Further, to increase the sealing properties, scale-like graphite may be mixed.

As a further example of the carbon-based sheet, there may be used a sheet made from, as a starting material, carbon fiber felt or felt made of fibers which can be carbonized, according to a method similar to that for the carbon fiber cloth above-mentioned.

The high bulk density carbon fiber felt and the carbon-based sheet are laminated through a carbonized or graphitized adhesive layer. To enhance the adhering strength, carbon-type powder (including minute spherical particles) or milled carbon fibers may be mixed with the adhesives used. The carbonized or graphitized adhesive layer may be made of pitch or resin which can be carbonized or graphitized. The adhesive layer is disposed at or in the vicinity of the interface between the carbon fiber felt and the carbon-based sheet.

Examples of the resin includes: thermosetting resin such as phenol resin, urea resin, epoxy resin, vinyl ester resin, diallyl phthalate resin, urethane resin, unsaturated polyester, polyimide or the like; and thermoplastic resin such as polyethylene, polypropylene, an ethylene-propylene copolymer, an ethylene-vinyl acetate copolymer, an ethylene-acrylate copolymer, polystyrene, acrylic resin, saturated polyester, polyamide or the like. One or more types of the pitch or resin may be used. Of the resins above-mentioned, there may be preferably used the thermosetting resin, and more preferably the phenol resin.

Figure 2:
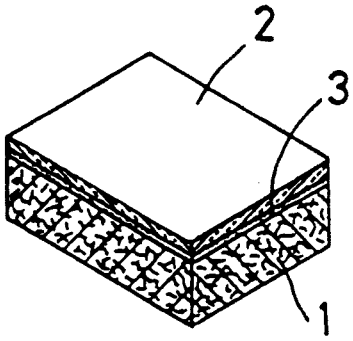
FIGS. 2 to 4 are schematic perspective views of thermal insulators in accordance with the present invention, illustrating the lamination conditions thereof.
Figure 3:
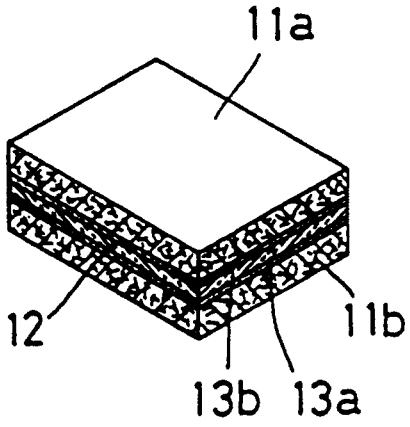
Figure 4:
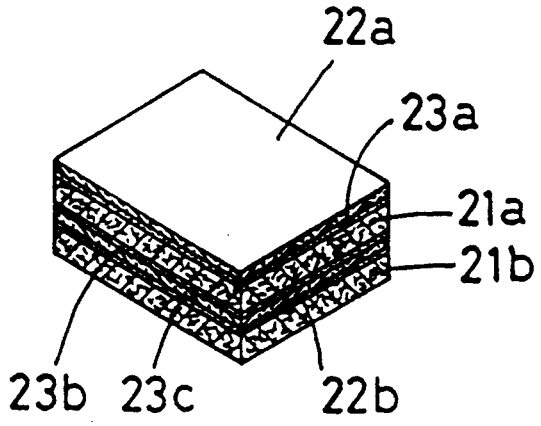

The high bulk density carbon fiber felt and the carbon-based sheet may be laminated in different manners. For example, as shown in FIG. 2, a carbon-based sheet 2 may be laminated on one side of high bulk density carbon fiber felt 1 through an adhesive layer 3. As shown in FIG. 3, high bulk density carbon fiber felt pieces 11*a*, 11*b* and a carbon-based sheet 12 may be laminated through adhesive layers 13*a*, 13*b* disposed on both sides of the carbon-based sheet 12. As shown in FIG. 4, a plurality of high bulk density carbon fiber felt pieces 21*a*, 21*b* and a plurality of carbon-based sheets 22*a*, 22*b* may be alternately laminated through carbonized or graphitized adhesive layers 23*a*, 23*b*, 23*c*.

When a plurality of high bulk density carbon fiber felt pieces or a plurality of carbon-based sheets are used, there may be used high bulk density carbon fiber felt pieces having different bulk densities or carbon-based sheets having different densities. Further, one felt layer may be composed of a plurality of high bulk density carbon fiber felt pieces.

The lamination forms of the high bulk density carbon fiber felt and the carbon-based sheet are not limited to those shown in FIGS. 2 to 4, but it is sufficient if at least one high bulk density carbon fiber felt and at least one carbon-based sheet are laminated each other through a carbonized or graphitized adhesive layer.

Such a thermal insulator may be manufactured by a method comprising the steps: of applying adhesives which can be carbonized or graphitized, on at least one surface of the surfaces to be bonded of carbon-based sheet and felt before calcination or high bulk density carbon fiber felt obtained after subjected to the calcination step; laminating the carbon-based sheet and the felt on each other; and calcinating the laminated sheet and felt.

The application amount of a resin solution is not particularly limited to a certain value, as far as resin does not permeate through the felt in its entirety. That is, it is sufficient to apply an amount of such a resin solution required for bonding the felt to the carbon-based sheet.

According to the present invention, the bulk density is not increased by compressingly molding felt which has been impregnated with resin. Accordingly, when laminating the felt of the present invention and the carbon-based sheet each other, it is sufficient to merely apply a slight load required for bonding the felt to the sheet. As to the calcination, when laminating the high bulk density carbon fiber felt and the graphite sheet each other, it is sufficient to calcinate the adhesives which can be carbonized or graphitized. This advantageously reduces the thermal energy required. It is noted that the calcination may be carried out in the same manner as mentioned earlier.

Alternatively, there may be manufactured a thermal insulator of which one or both surfaces are coated, according to a method comprising the steps of: coating at least one surface of the high bulk density carbon fiber felt with a coating agent prepared by mixing scale-like graphite and carbon-type powder (including milled carbon fibers of which lengths are less than 1 mm and minute carbon spherical particles such as mesocarbon micro-beads) with resin, preferably thermosetting resin; and carbonizing or graphitizing the felt thus coated.

The high bulk density carbon fiber felt coated with a carbon-based sheet or a coating agent, not only raises less nap, but also prevents melted splashes of the workpieces from entering the inside of the felt when the felt is used as a thermal insulator of a smelting furnace. Accordingly, the felt is less deteriorated.

According to the present invention, the high bulk density carbon fiber felt is prepared without impregnating the mixed fiber felt with resin, but the mixed fiber felt may be subjected to resin impregnation and calcination.

The following description will discuss examples of the present invention and comparative examples. However, the present invention should not be limited to these examples.

EXAMPLES

Example 1

There were mixed (i) 50 parts by weight of pitch-type carbon fibers (each having a diameter of 13 μm, specific gravity of 1.65, tensile strength of 70 kg/mm$^2$, tensile elastic coefficient of 3.5 ton/mm$^2$) and (ii) 50 parts by weight of phenol resin-type fibers ("KYNOL" manufactured by Japan Kynol Company, each fiber having a diameter of 14 μm, specific gravity of 1.27, tensile strength of 17.5 kg/mm$^2$, tensile elastic coefficient of 350 kg/mm$^2$).

With the use of a carding machine, there was formed a lap, from which felt having a thickness of about 20 mm and bulk density of about 0.13 g/cm$^3$ was made with a needle punch. In an inert atmosphere, the felt was calcined and carbonized at a temperature of 950° C., thereby to produce carbon fiber felt having a thickness of about 17 mm and bulk density of 0.16 g/cm$^3$. After carbonized, the felt was calcined in an inert atmosphere at a temperature of 2000° C., causing the felt to be graphitized. There was obtained carbon fiber felt having a thickness of about 16 mm and bulk density of 0.14 g/cm$^3$.

EXAMPLE 2

With the use of a lap comprising 50 parts by weight of the pitch-type carbon fibers and 50 parts by weight of the phenol resin-type fibers same as those used in Example 1, there was formed a felt having a unit-area weight of 770 g/m$^2$, a thickness of 7 mm and bulk density of 0.11 g/cm$^3$, in the same manner as done in Example 1. The felt was calcined, causing the felt to be graphitized, thereby to produce carbon fiber felt having a unit-area weight of 550 g/m$^2$, a thickness of 5 mm and bulk density of 0.11 g/cm$^3$.

EXAMPLE 3

There were mixed spun 50 parts by weight of the pitch-type carbon fibers and 50 parts by weight of the phenol resin-type fibers same as those used in Example 1. With the use of a carding machine, a lap was then prepared. The laps each of which was obtained in the manner above-mentioned, were put one upon another and needled, thereby to prepare felt having a unit-area weight of 4700 g/m$^2$, a thickness of about 35 mm and the entire bulk density of 0.134 g/cm$^3$. When needling the laps, the needle density, i.e. needling strength, was reduced in a direction from the lowest layer to the highest layer in the thickness direction of the laps.

The felt thus obtained was cut into three portions in the thickness direction and the bulk density of each portion was measured. The entire felt bulk density was changed in the thickness direction; that is, the higher layer had bulk density of 0.126 g/cm$^3$, the intermediate layer had bulk density of 0.140 g/cm$^3$ and the lower layer had bulk density of 0.158 g/cm$^3$.

The felt thus obtained was calcined in an atmosphere of nitrogen gas at a temperature of 2000° C., thereby to prepare carbon fiber felt having a unit-area weight of 4060 g/m$^2$, a thickness of about 29 mm and entire bulk density of 0.14 g/cm$^3$. The carbon fiber felt thus obtained was cut into three portions in the thickness direction and the bulk density of each portion was measured. The upper layer had bulk density of 0.136 g/cm$^3$, the intermediate layer had bulk density of 0.158 g/cm$^3$ and the lower layer had bulk density of 0.17 g/cm$^3$.

Example 4

There were mixed 50 parts by weight of the pitch-type carbon fibers and 50 parts by weight of the phenol resin-type fibers same as those used in Example 1. In the same manner as in Example 1, there was prepared carbon fiber felt impregnated with no resin, having a thickness of 30 mm and bulk density of 0.16 g/cm$^3$.

Comparative Example

The pitch-type carbon fibers of Example 1 were needled to prepare carbon fiber felt having a thickness of 10 mm and bulk density of 0.05 g/cm$^3$. Three pieces of the felt thus obtained were laminated in three layers.

Figure 5:
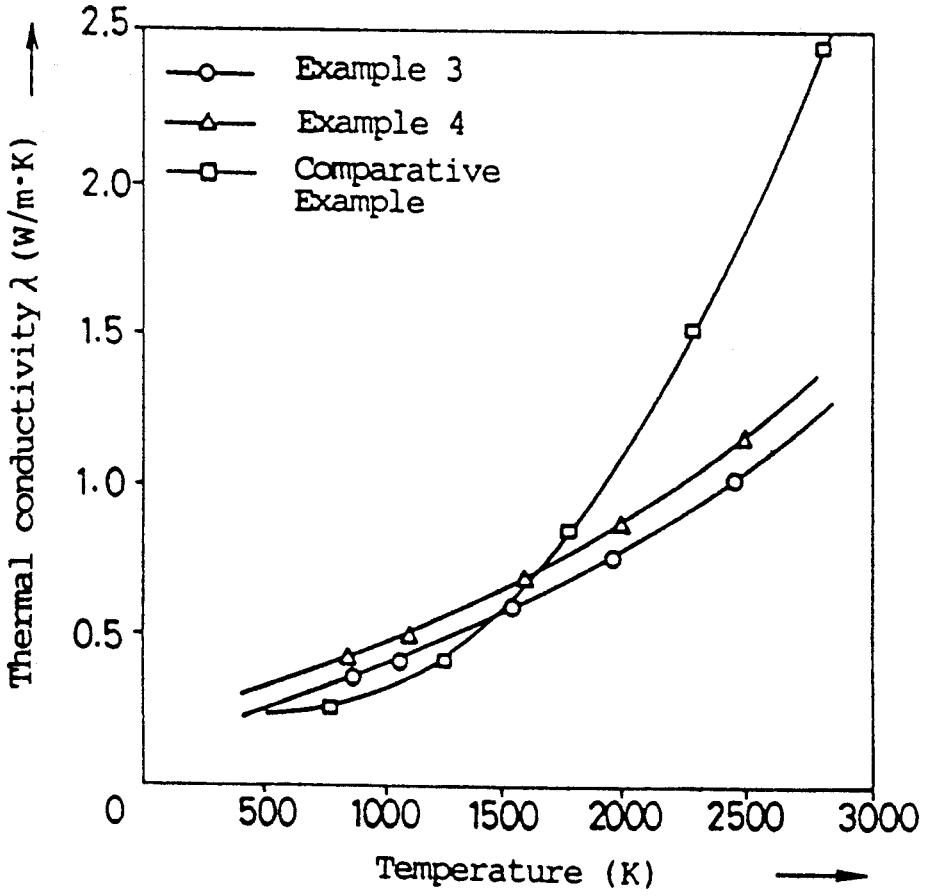
FIG. 5 is a graph illustrating the measurement results of thermal conductivity λ in each of Examples 3 and 4 and a Comparative Example.

The thermal conductivities of the carbon fiber felts of Examples 3 and 4 and the three-layer carbon fiber felt of Comparative Example were measured. The results are shown in FIG. 5. As apparent from FIG. 5, the carbon fiber felt of Example 4 and particularly the carbon fiber felt of Example 3 present smaller thermal conductivities in a high-temperature zone than that of the carbon fiber felt of Comparative Example. Thus, Example 4 and particularly Example 3 are superior in thermal insulating properties to Comparative Example.

The carbon fiber felts of Examples 3 and 4 were used, as mounted on a high-temperature furnace at 2500° C., repeatedly ten times as a thermal insulator. These felts underwent no change. This proves that these felts are excellent in durability. Further, it was easier to mount the carbon fiber felts of Examples 3 and 4 on the high-temperature furnace than to mount the carbon fiber felt of Comparative Example. The carbon fiber felts of Examples 3 and 4 presented good adhesion to the furnace wall and excellent mounting workability.

Example 5

There were mixed 50 parts by weight of the pitch-type carbon fibers and 50 parts by weight of the phenol resin-type fibers same as those used in Example 1. A lap was then prepared with the use of a carding machine. The lap was needled to prepare hollow cylindrical felt having an inner diameter of 264 mm $\phi$, an outer diameter of 304 mm $\phi$, a thickness of 20 mm and a height of 530 mm. A graphite cylindrical body having an outer diameter of 264 mm $\phi$, a thickness of 10 mm and a height of 550 mm was put in the hollow portion of the hollow cylindrical felt thus obtained. The felt was heated, at a speed of 1° C./minute in a nitrogen atmosphere, from an ambient temperature to 800° C. Thereafter, the felt was further heated to 2000° C. at a speed of 2° C./minute, and maintained at 2000° C. for one hour, causing the felt to be graphitized. Then, the graphite cylindrical body was removed from the felt.

The hollow cylindrical carbon fiber felt thus obtained had an inner diameter of 264 mm $\phi$, an outer diameter of 300 mm $\phi$, a thickness of 18 mm and a height of 500 mm, and presented bulk density of 0.13 g/cm$^3$. This carbon fiber felt hardly generated powder and was excellent in resiliency and cushioning properties. Further, this carbon fiber felt presented neither partial breakage nor warp.

Example 6

In the same manner as in Example 5, there were prepared a first hollow cylindrical felt having an inner diameter of 264 mm $\phi$, an outer diameter of 304 mm $\phi$, a thickness of 20 mm, a height of 530 mm and bulk density of 0.14 g/cm$^3$, and a second hollow cylindrical felt having an inner diameter of 306 mm $\phi$, an outer diameter of 346 mm $\phi$, a thickness of 20 mm, a height of 530 mm and bulk density of 0.10 g/cm$^3$. The graphite cylindrical body of Example 5 was put in the hollow portion of the first hollow cylindrical felt, and the second hollow cylindrical felt was put on the first hollow cylindrical felt.

The felt assembly was calcined in the same manner as in Example 5 to prepare carbon fiber felt having an inner diameter of 264 mm $\phi$, an outer diameter of 336 mm $\phi$, a thickness of 36 mm, bulk density at the inner side of 0.15 g/cm$^3$, bulk density at the outer side of 0.11 g/cm$^3$, and general bulk density of 0.12 g/cm$^3$.

EXAMPLE 7

There were prepared a first hollow cylindrical felt having an inner diameter of 264 mm $\phi$, an outer diameter of 304 mm $\phi$, a thickness of 20 mm, a height of 530 mm and bulk density of 0.11 g/cm$^3$, and a second hollow cylindrical felt having an inner diameter of 306 mm $\phi$, an outer diameter of 346 mm $\phi$, a thickness of 20 mm, a height of 530 mm and bulk density of 0.11 g/cm$^3$. Then, in the same manner as in Example 6, two-layer carbon fiber felt was prepared. This carbon fiber felt had an inner diameter of 264 mm $\phi$, an outer diameter of 336 mm $\phi$, a thickness of 36 mm, bulk density at the inner side of 0.12 g/cm$^3$, bulk density at the outer side of 0.12 g/cm$^3$, and general bulk density of 0.12 g/cm$^3$.

The two felt layers constituting each of the carbon fiber felts of Examples 6 and 7 closely sticked each other, presenting such integration as to produce no practical problem.

Example 8

There were mixed 50 parts by weight of the pitch-type carbon fibers and 50 parts by weight of the phenol resin-type fibers same as those used in Example 1. A web was then prepared with the use of a carding machine. The web was needled to prepare felt having a thickness of about 45 mm.

Bonded to one side of the felt thus obtained was a graphite sheet having a thickness of 0.2 mm to which a phenol resin solution had been applied. With a slight load applied, the felt-sheet assembly was heated, at a speed of 3° C./minute, from an ambient temperature to 180° C., and then maintained at the same temperature for one hour, causing the phenol resin to be set.

Thereafter, a graphite plate was placed on the sheet above-mentioned. With a slight load applied, the felt-sheet assembly was heated to 800° C. at a speed of 1° C./minute in a nitrogen atmosphere. The felt-sheet assembly was further heated to 2000° C. at a speed of 3° C./minute, and maintained at the same temperature for one hour, causing the assembly to be graphitized. The resultant thermal insulator had a thickness of 40 mm and bulk density of 0.15 g/cm$^3$.

The thermal insulator thus obtained hardly generated powder due to adhesives, and presented excellent resiliency, cushioning properties and adhesion at the bonded surfaces. Further, this thermal insulator presented neither partial breakage nor warp. The thermal insulating properties of the thermal insulator were evaluated. As a result, it was found that this thermal insulator was superior in thermal insulating properties to the carbon fiber felt having the same bulk density with no graphite sheet bonded.

What is claimed is:

1. A method of manufacturing high bulk density carbon fiber felt, comprising the steps of:

mixing together (i) first fibers of at least one of fibers selected from the group consisting of carbon fibers, pitch fibers subjected to an infusible treatment, rayon fibers, polyacrylonitrile fibers and cellulose fibers subjected to an infusible treatment, and (ii) phenol resin fibers which are longitudinally shrunk by calcination and which can be carbonized and/or graphitized;

mechanically compressing and entangling said first fibers with said phenol resin fibers to prepare a felt; and calcining said felt to shrink said phenol resin fibers and obtain a high bulk density carbon fiber felt having a bulk density of at least about 0.1 g/cm$^3$.

2. A method of manufacturing high bulk density carbon fiber felt according to claim 1, comprising steps of:

mixing together (i) said first fibers of at least one of fibers selected from the group consisting of carbon fibers, pitch fibers subjected to an infusible treatment, rayon fibers, polyacrylonitrile fibers and cellulose fibers subjected to an infusible treatment, and (ii) phenol resin fibers which are longitudinally shrunk by calcination and which can be carbonized and/or graphitized;

mechanically compressing and entangling said fibers and said phenol resin fibers, thereby to prepare hollow casing felt; and calcining said felt, to shrink said phenol resin fibers and prepare a high bulk density carbon fiber felt in the form of a hollow case.

3. A method of manufacturing high bulk density carbon fiber felt according to claim 1, comprising steps of:

mixing together (i) said first fibers of at least one of fibers selected from the group consisting of carbon fibers, pitch fibers subjected to an infusible treatment, rayon fibers, polyacrylonitrile fibers and cellulose fibers subjected to an infusible treatment, and (ii) phenol resin fibers which are longitudinally shrunk by calcination and which can be carbonized and/or graphitized;

mechanically compressing and entangling said first fibers with said phenol resin fibers, to prepare a plurality of hollow casing felt pieces which can be mounted concentrically;

concentrically mounting said hollow casing felt pieces; and calcining said concentrically mounted felt pieces to shrink said phenol resin fibers and prepare a high bulk density carbon fiber felt in the form of a hollow case.

4. A method of manufacturing high bulk density carbon fiber felt according to claim 1, wherein carbon fibers are used as the first fibers selected from the group (i) fibers.

5. A method of manufacturing high bulk density carbon fiber felt according to claim 1, wherein the group (i) fibers and the phenol resin fibers are mechanically compressed and entangled by needling.

6. A method of manufacturing high bulk density carbon fiber felt according to claim 1, wherein 5 to 95 parts by weight of group (i) fibers and 95 to 5 parts by weight of phenol resin fibers are mixed together.

7. A method of manufacturing high bulk density carbon fiber felt according to claim 5, wherein a plurality of webs or laps having different mixing ratios are needled.

8. A method of manufacturing high bulk density carbon fiber felt according to claim 5, wherein a plurality of webs or laps having the same mixing ratio are needled with the needle density changed in the thickness direction of said webs or laps.

9. A method of manufacturing high bulk density carbon fiber felt in the form of a hollow case according to claim 3, comprising the steps of:

preparing a plurality of hollow casing felt pieces having different bulk densities which can be mounted concentrically;

concentrically mounting said hollow casing felt pieces; and calcining said concentrically mounted felt pieces.

10. A method of manufacturing high bulk density carbon fiber felt according to claim 1, wherein the carbon fiber felt has an average bulk density of about 0.1 to 0.2 g/cm$^3$.

11. A method of manufacturing high bulk density carbon fiber felt according to claim 2, wherein the carbon fiber felt has an average bulk density of about 0.10 to 0.2 g/cm$^3$.

12. A method of manufacturing high bulk density carbon fiber felt according to claim 3, wherein the carbon fiber felt has an average bulk density of about 0.1 to 0.2 g/cm$^3$.

13. A method of manufacturing high bulk density carbon fiber felt according to claim 9, wherein the carbon fiber felt has an average bulk density of about 0.1 to 0.2 g/cm$^3$.

* * * * *